US007894755B2

(12) United States Patent
Lee

(10) Patent No.: US 7,894,755 B2
(45) Date of Patent: Feb. 22, 2011

(54) DEVELOPING UNIT WITH TONER REGULATOR AND IMAGE FORMING APPARATUS USING THE SAME

(75) Inventor: Jun-hee Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 709 days.

(21) Appl. No.: 11/839,770

(22) Filed: Aug. 16, 2007

(65) Prior Publication Data

US 2008/0131173 A1 Jun. 5, 2008

(30) Foreign Application Priority Data

Nov. 30, 2006 (KR) ..... 10-2006-0119753

(51) Int. Cl.
*G03G 15/08* (2006.01)

(52) U.S. Cl. ..... 399/284; 399/274; 399/279

(58) Field of Classification Search ..... 399/274, 399/279, 284
See application file for complete search history.

(56) References Cited

U.S. PATENT DOCUMENTS 4,457,257 A * 7/1984 Murakami et al. ..... 399/264
4,624,545 A * 11/1986 Yasuda et al. ..... 399/274
4,760,422 A * 7/1988 Seimiya et al. ..... 399/284
5,068,691 A * 11/1991 Nishio et al. ..... 399/284
5,232,500 A * 8/1993 Kamaji et al. ..... 399/284
5,412,458 A * 5/1995 Kamaji et al. ..... 399/272
5,649,197 A * 7/1997 Fujita ..... 399/260
5,761,589 A * 6/1998 Kido et al. ..... 399/284
2007/0177906 A1* 8/2007 Yamanaka et al. ..... 399/279
2008/0063437 A1* 3/2008 Sheen ..... 399/284

FOREIGN PATENT DOCUMENTS

JP 63213873 A * 9/1988
JP 6-342238 12/1994
JP 07036277 A * 2/1995
JP 7-319353 12/1995
JP 9-244498 9/1997
JP 11-95634 4/1999
JP 2000-098737 4/2000

OTHER PUBLICATIONS

English Abstract of JP 07036277 A to Umeno et al.*
English Abstract to Murazaki JP63213873A.*

* cited by examiner

*Primary Examiner*—Ryan D Walsh
(74) *Attorney, Agent, or Firm*—Stanzione & Kim, LLP

(57) ABSTRACT

A developing unit mounted to a main frame of an image forming apparatus comprising a photosensitive medium where an electrostatic latent image is formed and provides a toner to the photosensitive medium to form an image, the developing unit including a developing frame, a developing member installed in the developing frame to provide a toner to the photosensitive medium to develop an image, a blade to regulate a toner layer on the developing member, and a position changing part to change a position of the blade on the developing member.

18 Claims, 13 Drawing Sheets

DEVELOPING UNIT WITH TONER REGULATOR AND IMAGE FORMING APPARATUS USING THE SAME

CROSS-REFERENCE TO RELATED APPLICATIONS

This application claims priority from Korean Patent Application No. 10-2006-0119753, filed on Nov. 30, 2006 in the Korean Intellectual Property Office, the disclosure of which is incorporated herein by reference in its entirety.

BACKGROUND OF THE INVENTION

1. Field of the Invention

The present general inventive concept relates to a developing unit which supplies a toner to an electrophotographic image forming apparatus to develop an image and an image forming apparatus using the same, and more particularly, to a developing unit where a blade is installed in different positions according to whether the developing unit is mounted to an image forming apparatus, and an image forming apparatus using the same.

2. Description of the Related Art

An electrophotographic image forming apparatus includes a developing unit which supplies a toner to an electrostatic latent image formed in a photosensitive medium to develop an image.

FIG. 1 is a schematic perspective view of a main body in a conventional developing unit. Referring to FIG. 1, the conventional developing unit includes a developing member 10 and a blade 20. The developing member 10 is installed to be in or out of contact with a photosensitive drum 30 and adheres a toner thereon to supply it to the photosensitive drum 30. The blade 20 regulates a height of the toner layer adhered on a surface of the developing member 10 to be a thin layer by pressing the surface of the developing member 10 at a constant pressure. Thus, the toner adhered on the surface of the developing member 10 becomes a thin layer by the blade 20 and is provided to the photosensitive drum 30, thereby developing an electrostatic latent image formed in the photosensitive drum 30.

The blade 20 includes a bending part 21 which is formed by a bending process and is made of an elastic metal plate. The blade 20 contacts the developing member 10 at a fixed position at a constant pressure to regulate a thickness of the toner layer.

The developing member 10 is generally provided as a conductive rubber roller which includes a compound of a nitrile butadiene rubber (NBR) based synthetic rubber and Epichiorohydrin Copolymer (ECO) or a silicon based rubber. Further, the conventional developing unit uses single component toner made of polyester resin to which a wax, a coloring agent, and a charge control agent are added therein and which is coated with silica and metal oxide thereon.

The developing unit with the aforementioned configuration is distributed with the toner being thereinside before installed on the image forming apparatus to be used. Here, the toner is positioned in the bending part 21 between the blade 20 and the developing member 10, and the developing member 10 is at a standstill. Thus, the coating agent of the toner is partially separated by the pressure of the free end portion of the blade 20 and adhered to the bending part 21 and the developing member 10 which is in contact with the bending part 21.

When an image is formed by the developing unit, a streak and a migration are generated.

The streak is generated by the coating agent adhered to the bending part 21 and formed on a printing medium in a proceeding direction of the printing medium when forming an image. The migration is generated by the coating agent adhered on the developing member 10 and formed on the printing medium in a parallel direction with the proceeding direction of the printing member in a period of rotation of the developing member 10.

In the conventional developing unit, the free-end portion of the blade 20 is fixed in a developing frame and contacts the developing member 10 at a high pressure, thus generating a significant amount of stress on the blade 20, the bending part 21 of the blade 20, and the developing member 10. During operation, the developing member 10 is rotated, thus no one area of the developing member 10 is subject to the stress for an excessive amount of time. Accordingly, a surface of the developing member 10, which is in contact with the blade 20 and the bending part 21 of the blade 20, may be deformed between operations while the developing member 10 is not being rotated.

SUMMARY OF THE INVENTION

The present general inventive concept provides a developing unit which has a structure to prevent a defective image due to adhesion of a coating agent of a toner and deformation of a developing member and a blade, and an image forming apparatus using the same.

Additional aspects and utilities of the present general inventive concept will be set forth in part in the description which follows and, in part, will be obvious from the description, or may be learned by practice of the present general inventive concept.

The foregoing and/or other aspects and utilities of the present general inventive concept may be achieved by providing a developing unit comprising a developing frame, a developing member which is installed in the developing frame and provides a toner to the photosensitive medium to develop an image, a blade to regulate a toner layer on the developing member, and a position changing part to change a position of the blade on the developing member.

The position changing part may comprise a bracket to support the blade movably installed on the developing frame, and a position adjusting member to move the bracket to adjust the contact position of the blade on the developing member.

The position changing part may change a contact position of the blade on the developing member if the developing frame is mounted to a main frame of an image forming apparatus.

The position adjusting member may move the bracket so that the blade moves in a direction far away the developing member when the developing frame is mounted to the main frame.

The position adjusting member may comprise a cam which reciprocatively moves the bracket, and a lever to adjust the cam.

The position changing part may further comprise an elastic member to elastically press the bracket so that the blade is elastically biased against the developing member.

The blade may comprise a bending part which is bent in its end portion near the developing member.

A contact position of the blade may be adjusted by the position adjusting member so that the bending part is in contact with the developing member when the developing unit is mounted to the image forming apparatus and a portion of the blade other than the bending part is in contact with the developing member when the developing unit is not mounted to the image forming apparatus.

A bending radius of the bending part may be in a range of 0.05 mm to 0.5 mm.

The foregoing and/or other aspects and utilities of the present general inventive concept may further be achieved by providing an image forming apparatus comprising a housing having a main frame, a photosensitive medium to form an electrostatic latent image, a developing unit installed on the main frame to provide a toner to the photosensitive medium to form an image, a transfer unit to transfer the image formed in the developing unit to a printing medium, and a fusing unit to fuse the image transferred to the printing medium.

The position changing part may comprise a bracket to support the blade movably installed on the developing frame, a position adjusting member to adjust the contact position of the blade on the developing member, and an elastic member to elastically press the bracket so that the blade is elastically biased against the developing member.

The position adjusting member may move the bracket so that the blade moves in a direction away from the developing member when the developing frame is mounted to the main frame.

The position adjusting member may comprise a cam which reciprocatively moves the bracket, and a lever to adjust the cam.

The image forming apparatus may further comprise a guide member disposed in the main frame to guide the developing unit to be mounted, and to regulate a position of the lever to determine a position of the blade when the developing unit is mounted.

The blade may comprise a bending part which is bent in its end portion near the developing member.

A contact position of the blade may be adjusted by the position adjusting member so that the bending part is in contact with the developing member when the developing unit is mounted to the image forming apparatus and a portion of the blade other than the bending part is in contact with the developing member when the developing unit is not mounted to the image forming apparatus.

The foregoing and/or other aspects and utilities of the present general inventive concept may further be achieved by providing an image forming apparatus comprising a photosensitive medium, and a developing unit to develop an image of the photosensitive medium using a developer, the developing unit having a developing frame, a develop member disposed in the developing frame to provide a toner to an outside thereof, and a blade to regulate a toner layer, to change from a first configuration to a second confirmation upon activation of the developing member, and to automatically revert to the first configuration upon deactivation of the developing member.

The foregoing and/or other aspects and utilities of the present general inventive concept may further be achieved by providing a developing unit, comprising a developing frame, a developing member disposed in the developing frame to provide a toner to an outside thereof, and a blade to regulate a toner layer, to change from a first configuration to a second configuration upon activation of the developing member, and to automatically revert to the first configuration upon deactivation of the developing member.

The first configuration may position the blade further away from the developing member relative to the second configuration.

Less pressure may be exerted on the developing member in the first configuration relative to the second configuration.

The foregoing and/or other aspects and utilities of the present general inventive concept may further be achieved by providing a blade apparatus for a developing unit, the developing unit comprising a developing frame, and a developing member installed in the developing frame and providing a toner to a photosensitive medium to develop an image; and the blade apparatus comprising a blade to regulate a toner layer on the developing member; and a position changing part to change a position of the blade on the developing member.

BRIEF DESCRIPTION OF THE DRAWINGS

These and/or other aspects and utilities of the present general inventive concept will become apparent and more readily appreciated from the following description of the exemplary embodiments, taken in conjunction with the accompanying drawings, in which.

DETAILED DESCRIPTION OF THE PREFERRED EMBODIMENTS

Figure 1:
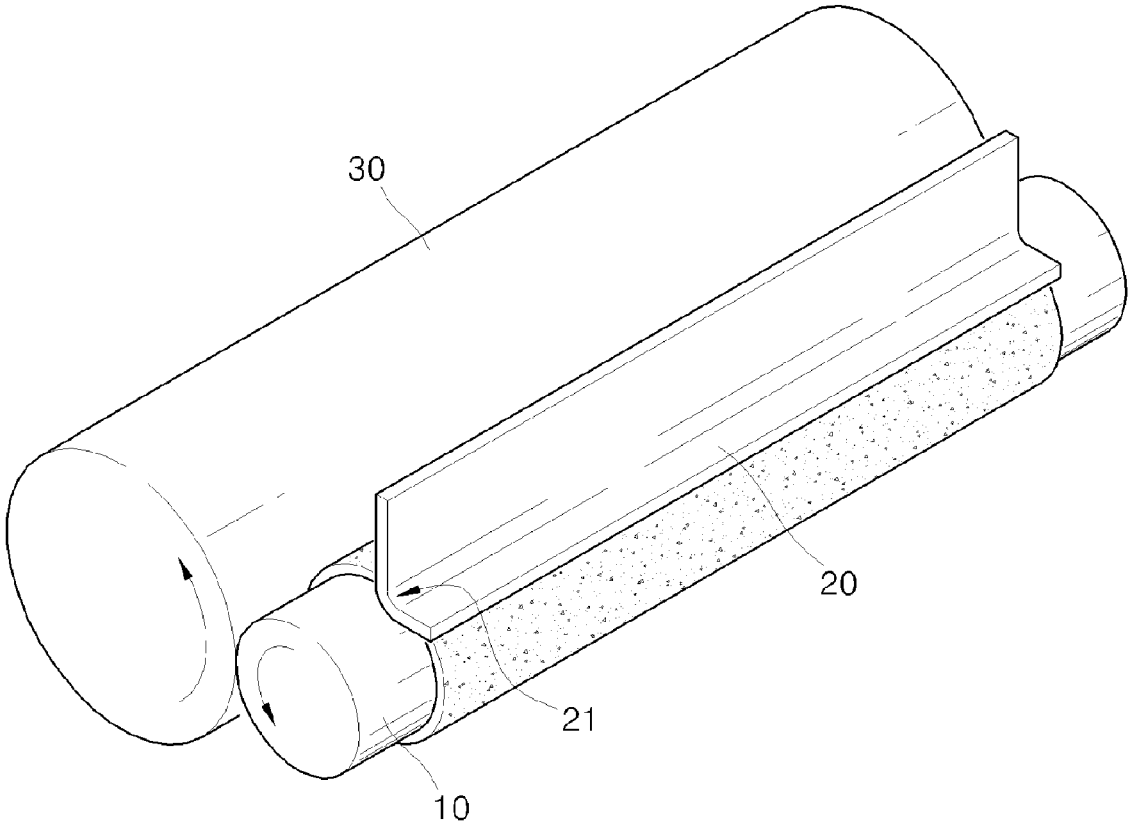
FIG. 1 (RELATED ART)
FIG. 1 is a schematic perspective view of a main body in a conventional developing unit.

Reference will now be made in detail to the embodiments of the present general inventive concept, examples of which are illustrated in the accompanying drawings, wherein like reference numerals refer to like elements throughout. The exemplary embodiments are described below so as to explain the present general inventive concept by referring to the figures.

Figure 2A:
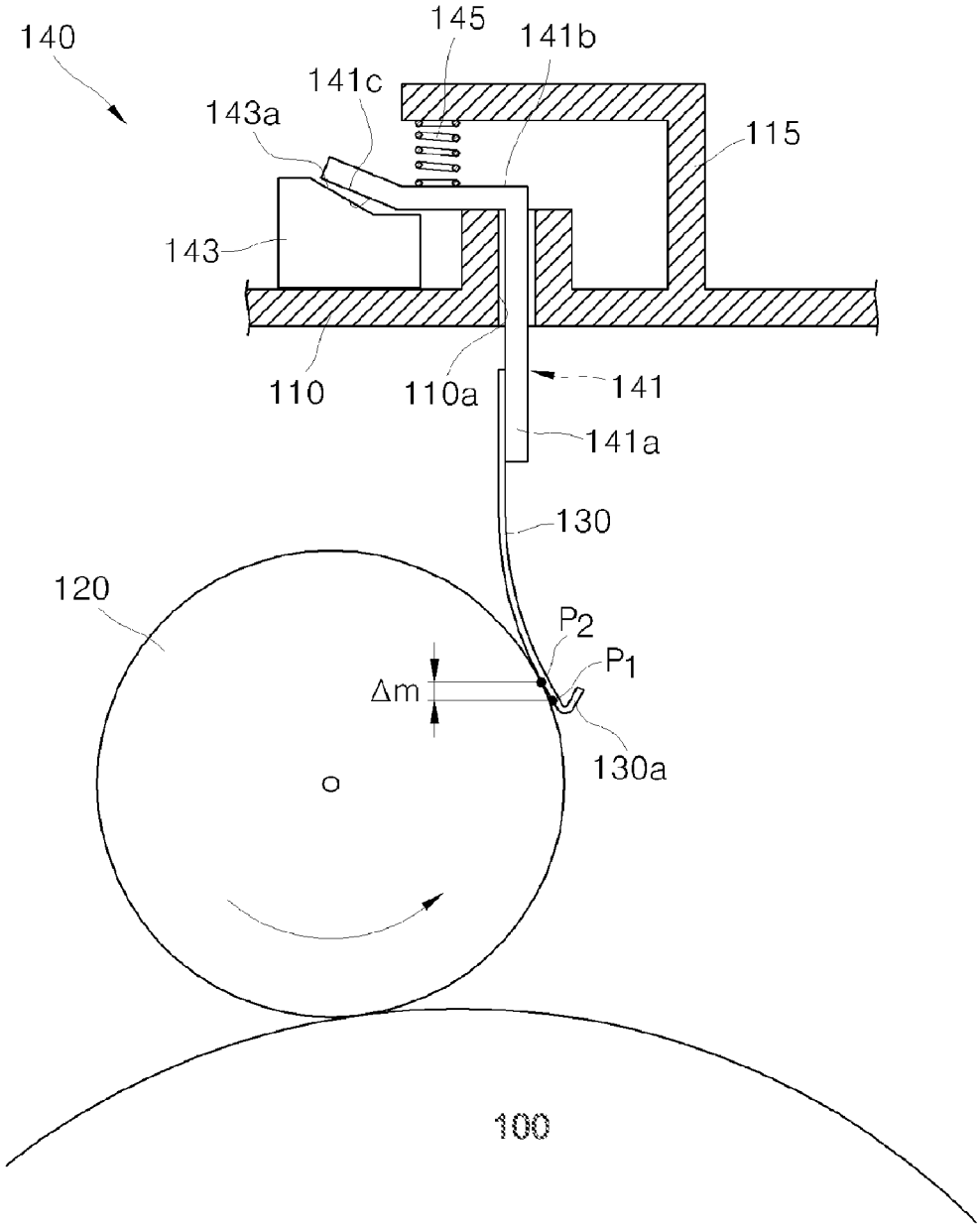
FIGS. 2A and 2B are schematic cross-sectional views of a developing unit according to a first exemplary embodiment of the present general inventive concept, illustrating views before and after mounted to the developing unit, respectively.
Figure 2B:
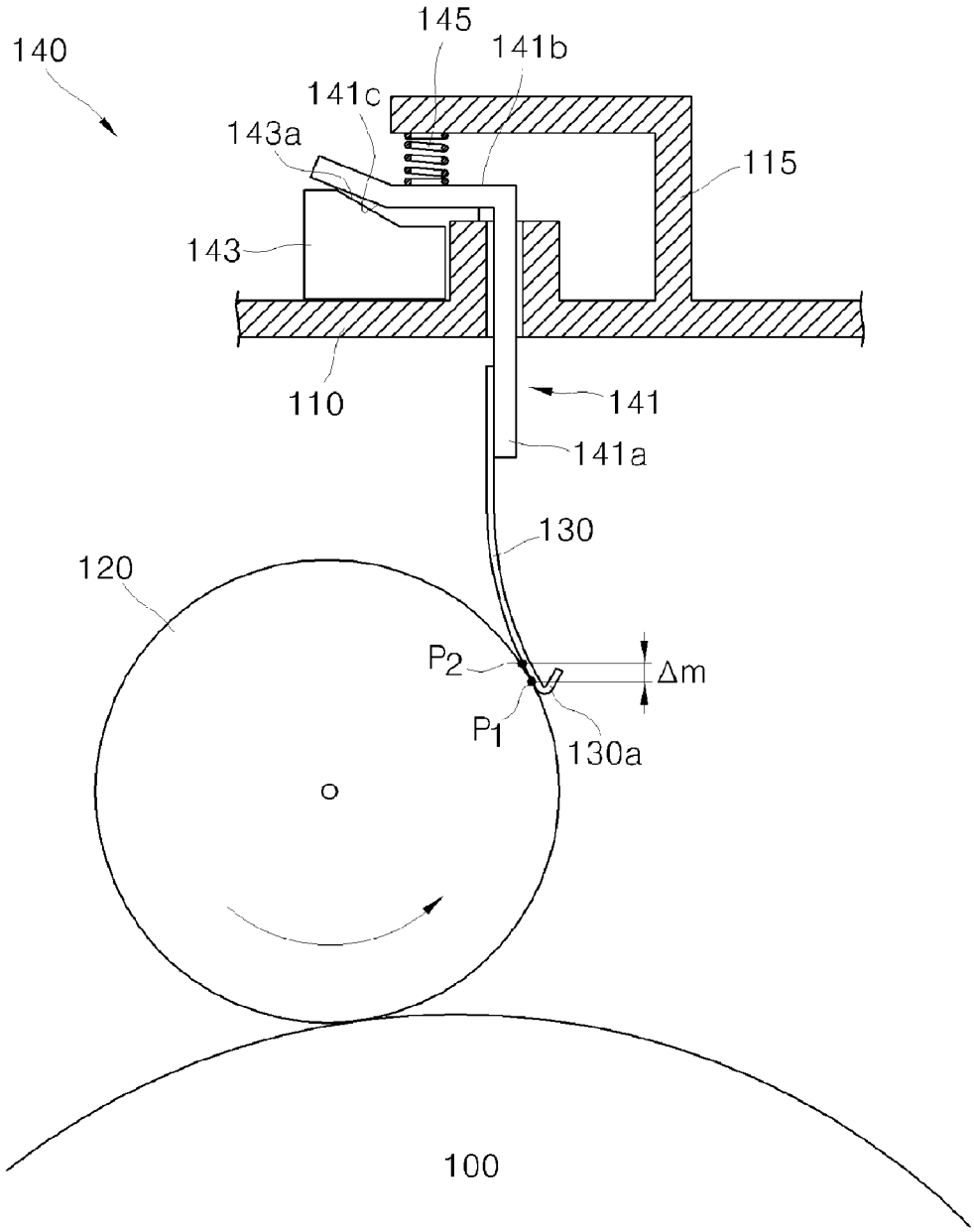

FIGS. 2A and 2B are schematic cross-sectional views of a developing unit according to a first exemplary embodiment of the present general inventive concept. FIG. 2A illustrates the developing unit before being mounted to an image forming apparatus, and FIG. 2B illustrates the developing unit after being mounted to the image forming apparatus.

Referring to FIGS. 2A and 2B, the developing unit, according to the first exemplary embodiment of the present general inventive concept, includes a developing frame 110, a developing member 120 which is installed in the developing frame 110 and contains a toner as a developer therein and provides the toner to a photosensitive medium 100 where an electrostatic latent image is formed to develop an image, a blade 130 to regulate a toner layer on the developing member 120, and a position changing part 140, which changes contact positions $P_1$ and $P_2$ of the blade 130 with the developing member 120.

The developing unit, according to the first exemplary embodiment of the present general inventive concept, is provided as a component which is detachably connected to a main frame (not illustrated) of the image forming apparatus, which includes the photosensitive medium 100. The developing unit is manufactured and distributed separate from the image forming apparatus.

When the developing unit is mounted to the main frame, the developing member 120 is either rotatably in contact with the photosensitive medium 100 (see FIG. 2B) or is not in contact with the photosensitive medium 100.

The developing frame 110 supports the developing member 120 to allow rotation of the developing member 120, and is provided as a reference point when the blade 130 and the position changing part 140 are installed.

The developing member 120 only rotates during operation to form an image and is otherwise in a stationary position when the developing member 120 is not being operated.

The blade 130 has a free end portion that contacts a surface of the developing member 120 at a constant pressure and regulates a toner layer formed on the developing member 120. The blade 130 is made of a material with sufficient durability, such as metal, to maintain a constant pressure at the free end portion in contact with the developing member 120 when forming an image. Although the blade 130 can be of a variable thickness, the blade 130 of the exemplary embodiment is 0.07 mm to 0.2 mm in thickness. The blade 130 includes a bending part 130*a* which is bent at a predetermined curvature at an end portion to the developing member 120. A bending radius of the bending part 130*a* may be 0.05 mm to 0.5 mm. The position changing part 140 is installed in the developing frame 110 and changes a contact position of the blade 130 on the developing member 120.

The position changing part 140 includes a bracket 141 to support the blade 130 and a position adjusting member 143 to adjust a contact position of the blade 130. The bracket 141 is movably installed on a guide slit 110*a* formed on the developing frame 110 and includes a supporting part 141*a* supportingly joined to the blade 130, a pressing part 141*b* bent from the supporting part 141*a* and elastically pressed by an elastic member 145, and an adjusting part 141*c* in selective contact with the position adjusting member 143. The blade 130 is attached to the supporting part 141*a* by welding, a bonding agent, or other suitable manner of attachment.

The position changing part 140 changes a contact position of the blade 130 on the developing member 120 depending on whether the developing unit is mounted to the main frame or mounted to another element. That is, the position adjusting member 143 moves the bracket 141 in one direction so that the blade 130 moves away from the developing member 120 when the developing frame 110 is mounted to the main frame. Thus, the position adjusting member 143 is provided to move in a space between the adjusting part 141*c* and the developing frame 110. When the developing frame 110 is mounted to the main frame, the position adjusting member 143 moves from a position illustrated in FIG. 2A to a position illustrated in FIG. 2B and a slant upper part 143*a* contacts the adjusting part 141*c*, thereby moving the bracket 141. Accordingly, when the developing unit is mounted, a position of the developing member 120, which contacts the blade 130, moves as much as $\Delta m$ from a position $P_2$ to a position $P_1$ in a mounting state.

The position changing part 140 may further include the elastic member 145, which elastically presses the pressing part 141*b* of the bracket 141 so that the blade 130 is elastically biased toward the developing member 120. The elastic member 145 is interposed between a supporting frame 115 and the pressing part 141*b*, which are formed separately in the developing frame 110. Accordingly, the elastic member 145 elastically presses the pressing part 141*b*, thereby maintaining the position of the developing member 120, which contacts the blade 130 at the position $P_2$ when the developing unit is not mounted and at the position $P_1$ when the developing unit is mounted.

In the present exemplary embodiment, the position changing part 140 changes a position of the blade 130 depending on whether the developing unit is mounted to the main frame. Alternatively, a user may adjust the position changing part 140 to change the position of the blade 130 without regard to whether the developing unit is mounted to the main frame.

Hereinafter, an operation of the developing unit according to the first exemplary embodiment of the present general inventive concept will be described comparing FIG. 2A with FIG. 2B.

The developing unit is manufactured and distributed separate from the image forming apparatus. FIG. 2A illustrates an arrangement of components in a separate developing unit. FIG. 2B illustrates an arrangement of the components when the developing unit is mounted to the image forming apparatus.

The developing member 120, the developing frame 110, and the supporting frame 115 are maintained in their positions. On the other hand, the bracket 141 provided with the blade 130 as a single body moves up and down through the guide slit 110*a* provided in the developing frame 110. In FIG. 2A, the bracket 141 is seated in the developing frame 110 and disposed separately from the position adjusting member 143. The bracket 141 is elastically biased downward by the elastic member 145 provided between the supporting frame 115 and the pressing part 141*b*. The blade 130 contacts the developing member 120 at a portion along the blade 130 other than the bending part 130*a*. In the non-mounting state illustrated in FIG. 2A, the coating agent of the toner or the like may be held between the developing member 120 and the blade 130 at the contact position $P_2$. The coating agent may be adhered at a part of the position $P_2$ of the blade 130 while the coating agent is pressed with a predetermined pressure between the blade 130 and the developing member 120.

Since the position $P_2$ in FIG. 2A is not a bent portion, a contact area of the developing member 120 and the blade 130 is wide relative to the bent position in FIG. 2B. Thus, the pressure applied between the developing member 120 and the blade 130 is an interactive pressure that is distributed so that the pressure is decreased. Accordingly, the developing member 120 and the blade 130 are prevented from being deformed in the non-mounting state and then the developing member is not in operation. Further, the coating agent of the toner and degree of adherence on the developing member 120 is decreased due to the low interactive pressure, thereby reducing the migration generated by adhesion of the toner on the developing member 120. Referring to FIG. 2B, when the user mounts the developing unit to the image forming apparatus, a portion of the image forming apparatus and the position adjusting member 143 come into contact by a mounting force, and the position adjusting member 143 moves from the position of FIG. 2A to the position of FIG. 2B. Accordingly, the adjusting part 141*c* of the bracket 141 moves upward. Also, the blade 130 moves in a direction away from the developing member 120 as much as $\Delta m$ and the bending part 130*a* comes into contact with the developing member 120 at the position $P_1$. The position $P_2$ of the blade 130 where the developing agent is adhered in the non-mounting state moves to a different position with respect to the developing member 120 in the mounting state, and the bending part 130*a* comes into contact with the developing member 120 at the position $P_1$, thereby preventing generation of a streak.

Although the position variation Δm could be variable, in the exemplary embodiment, the positional variation Δm is in a range of 0.5 mm to 5 mm. If the positional variation Δm is excessively large, e.g., out of 5 mm, it is not easy to provide a space where the position adjusting member 143 moves since the developing unit is mounted to the image forming apparatus. Further, it is not easy for the position adjusting member 143 to obtain a moving distance as much as the positional variation. Also, the blade 130 itself moves so that the toner may leak. If the positional variation Δm is less than 0.5 mm, the blade 130 does not avoid the coating agent adhered at the position $P_2$, thereby generating the streak.

Figure 3A:
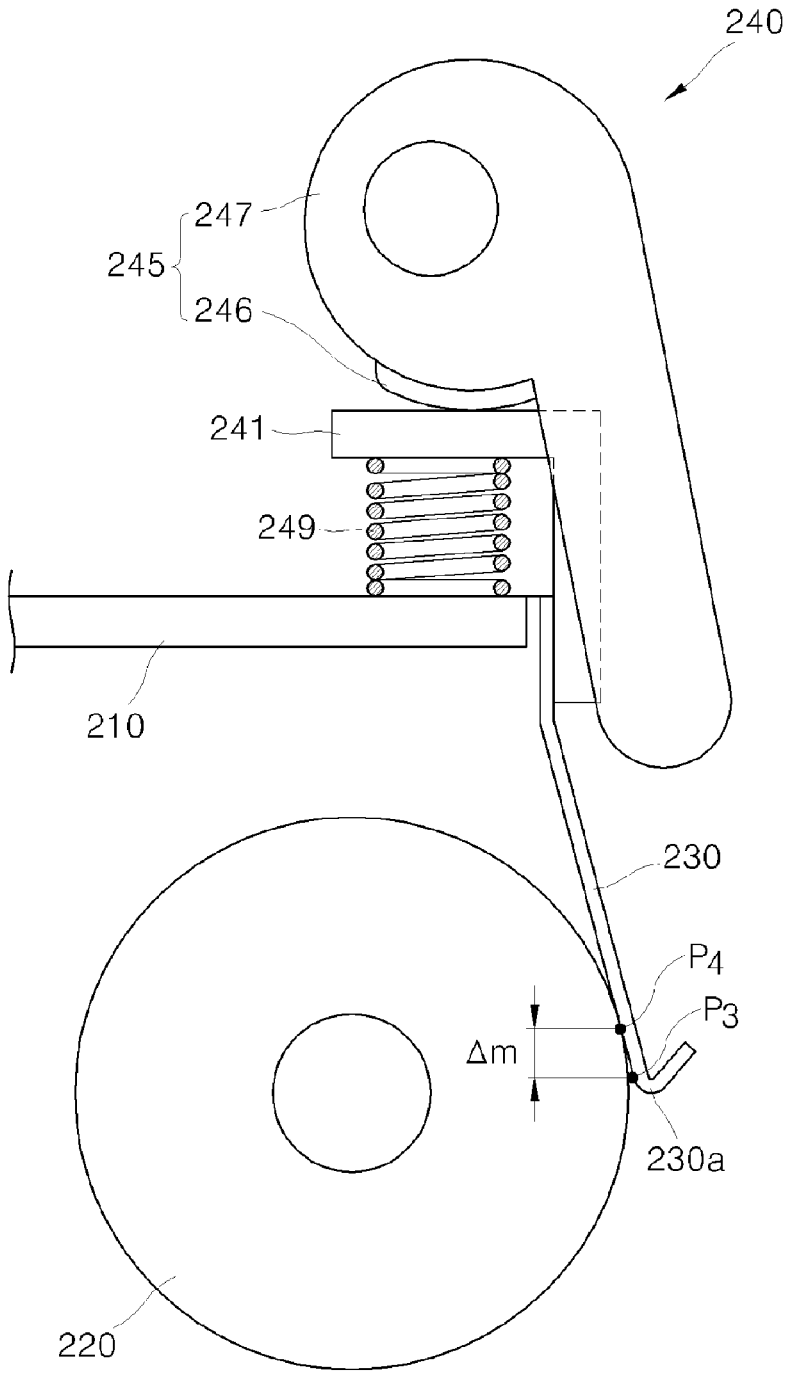
FIGS. 3A and 3B are schematic cross-sectional views of a developing unit according to a second exemplary embodiment of the present general inventive concept, illustrating views before and after mounted to the developing unit, respectively.
Figure 3B:
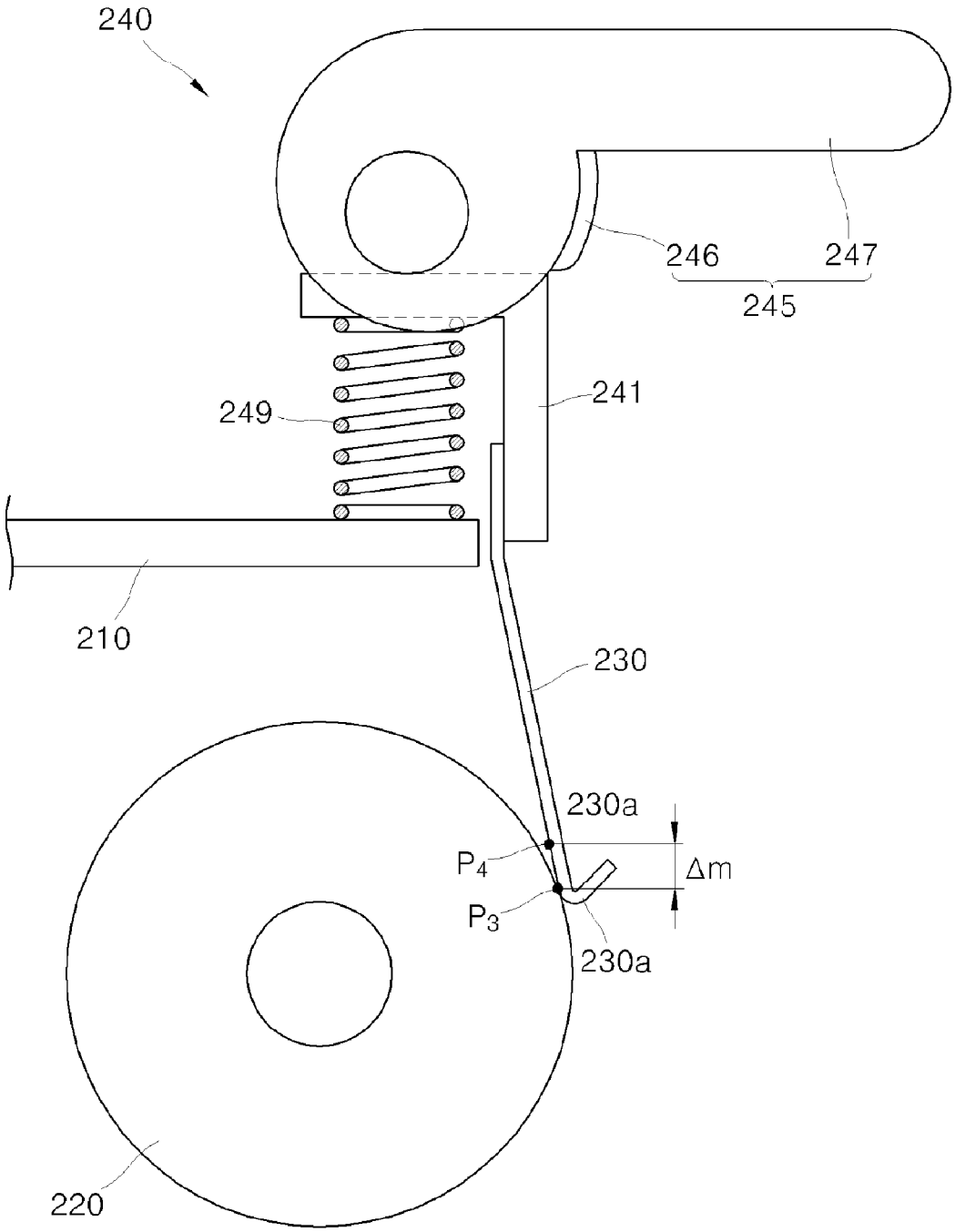
Figure 4:
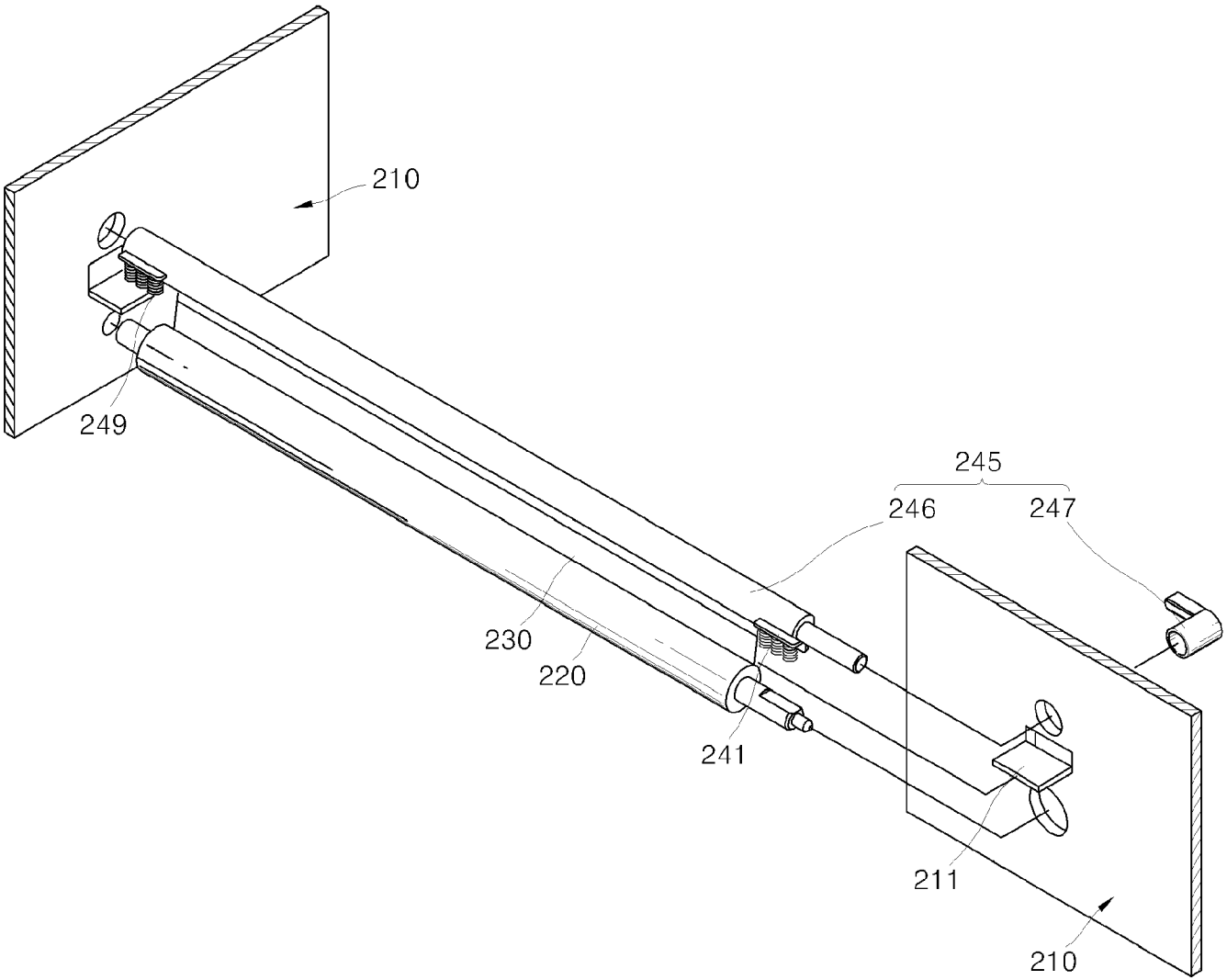
FIG. 4 is a perspective view of a part of the developing unit according to the second exemplary embodiment of the present general inventive concept.
Figure 5A:
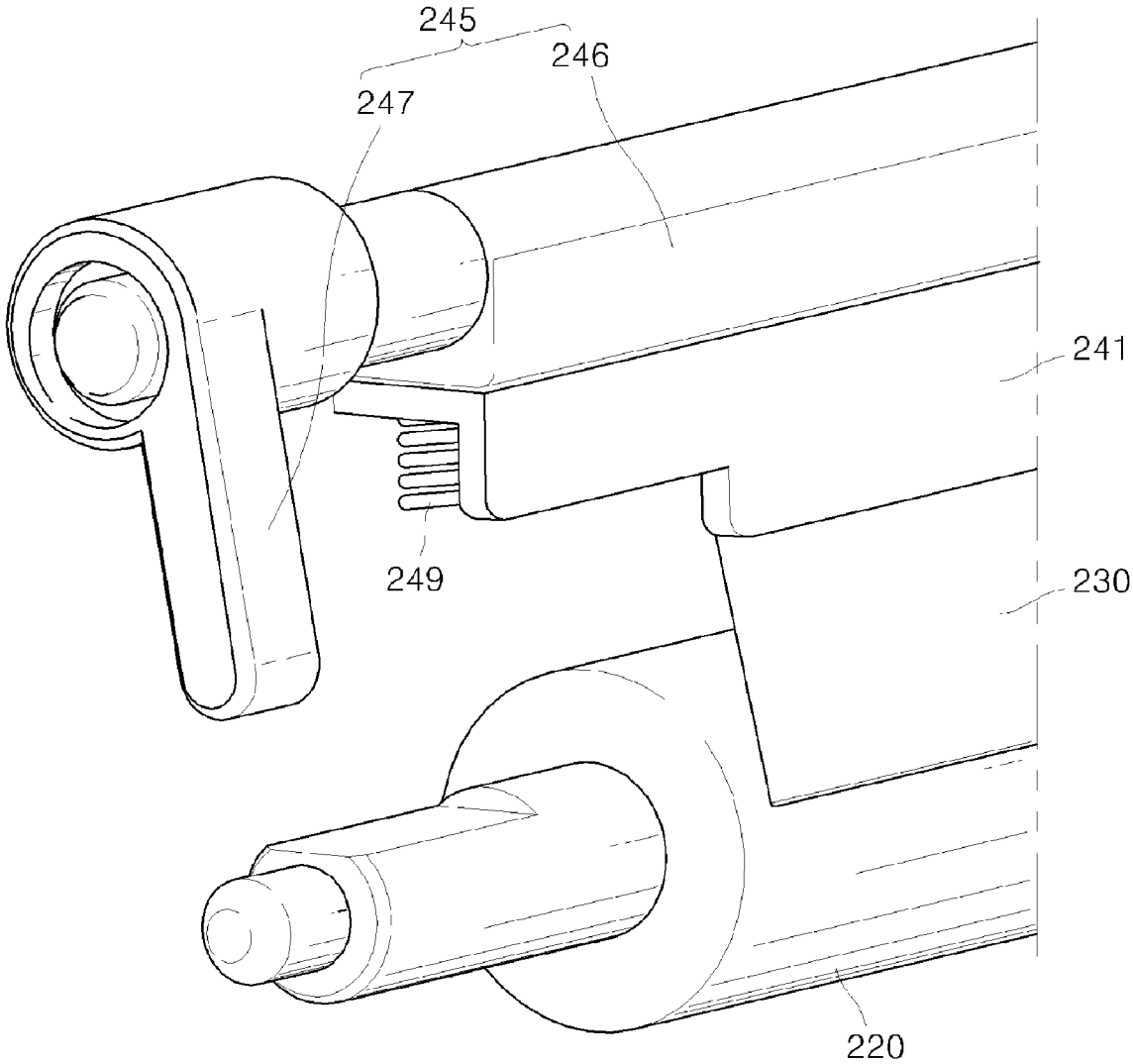
FIGS. 5A and 5B are partial perspective views of the developing unit according to the second exemplary embodiment of the present general inventive concept before and after mounted to the developing unit, respectively.
Figure 5B:
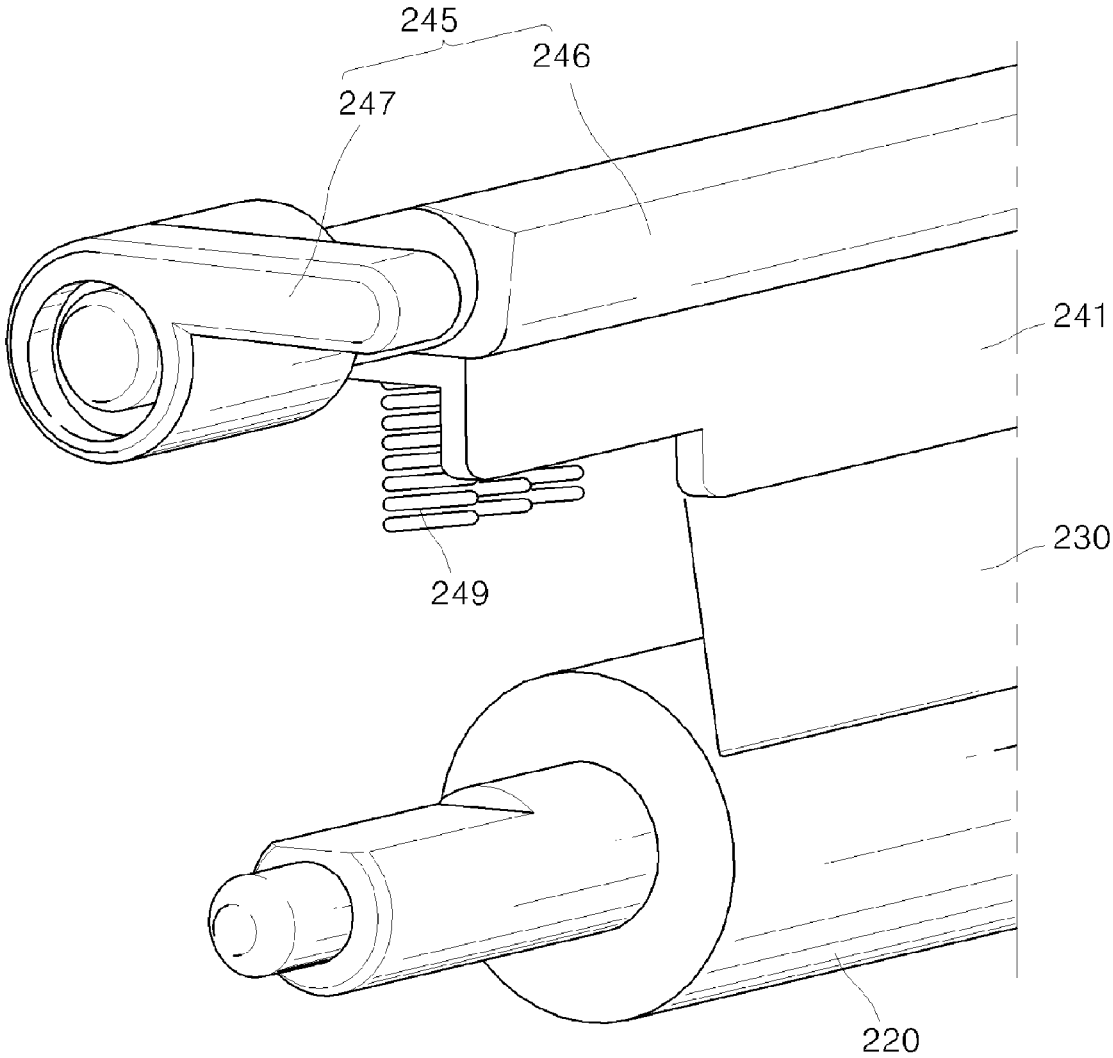

FIGS. 3A and 3B are schematic cross-sectional views of a developing unit according to a second exemplary embodiment of the present general inventive concept. FIG. 3A illustrates the developing unit before being mounted to an image forming apparatus, and FIG. 3B illustrates the developing unit after being mounted to the image forming apparatus. FIG. 4 is a perspective view of a main body in the developing unit according to the second exemplary embodiment of the present general inventive concept. FIGS. 5A and 5B respectively illustrate partial perspective views of the developing unit before and after being mounted to the image forming apparatus.

Referring to the drawings, a developing unit according to a second exemplary embodiment of the present general inventive concept includes a developing frame 210, a developing member 220 installed on the developing frame 210 and providing a toner to a photosensitive medium (not illustrated) where an electrostatic latent image is formed to develop an image, a blade 230 to regulate a developing agent layer on the developing member 220, and a position changing part 240 to change contact positions $P_3$ and $P_4$ of the blade 230 on the developing member 220.

In the second exemplary embodiment, the developing unit has substantially the same configuration as that in the first exemplary embodiment, in regards to the contact positions $P_3$ and $P_4$ of the blade 230 on the developing member 220 changeable depending on whether the developing unit is mounted to the image forming apparatus or mounted to another element, and the configuration of the blade 230. However, the position changing part 240 of the second exemplary embodiment has a different configuration of the position changing part 140 of the first exemplary embodiment.

The position changing part 240 movably supports the blade 230 having a bending part 230*a* which contacts the developing member 220 when the developing unit is mounted. Thus, the position changing part 240 includes a bracket 241 movably installed on the developing frame 210 and the position adjusting member 245, which moves the bracket 241 to adjust a contact position of the blade 230 on the developing member 220.

The position changing part 240 further includes an elastic member 249, which elastically presses the bracket 241 so that the blade 230 is elastically biased against the developing member 220. The elastic member 249 is interposed between a supporting part 211, formed in a predetermined position of the developing frame 210, and the bracket 241 as illustrated in FIG. 4 and prevents the blade 230, operated by the position adjusting member 245, from being movable in operation positions illustrated in FIGS. 3A and 3B, respectively.

The position adjusting member 245 allows the blade 230 to be disposed as illustrated in FIGS. 3A and 5A when the developing unit is not in use. The position adjusting member 245 moves the bracket 241 so as to dispose the blade 230 as illustrated in FIGS. 3B and 5B when the developing unit is mounted to be in a usable state. Thus, the position adjusting member 245 includes a cam 246 and a lever 247.

The cam 246 is rotatably installed in the developing frame 210 and has an eccentrical external curved surface. The lever 247 is installed in at least one side of the cam 246 and adjusts rotation of the cam 246.

The cam 246 is adjusted by operation of the lever 247 so as to move the bracket 241 up and down.

As illustrated in FIG. 3A, the lever 247 is disposed almost uprightly in the non-mounting state. Here, the cam 246 allows the bracket 241 to move downward so that the blade 230 is in contact with the developing member 220 at a contact position $P_4$. An end portion of the lever 247 is disposed in a substantially vertical direction downward in the non-mounting state so that a main frame of the image forming apparatus can regulate the lever 247 when the developing unit is mounted to the image forming apparatus, thereby automatically changing a position of the lever 247 as illustrated in FIG. 3B.

On the other hand, the lever 247 is disposed in a substantially horizontal direction as illustrated in FIG. 3B in the mounting state. As the cam 246 moves to releasingly press the bracket 241, the bracket 241 is moved upward by elastic bias of the elastic member 249 relative to FIG. 3A. Accordingly, the blade 230 is in contact with the developing member 220 at a position $P_3$ with as much as a positional variation Δm from a position $P_4$. The lever 247 is disposed substantially uprightly so that the lever 247 can be regulated by a guide member of the image forming apparatus when the developing unit is mounted to the image forming apparatus, thereby maintaining the mounting state illustrated in FIG. 3B. A positional variation Δm of the blade 230 is the same as one in the first exemplary embodiment.

Hereinafter, an image forming apparatus according to an exemplary embodiment of the present general inventive concept will be described with reference to FIGS. 6 through 8C.

Figure 6:
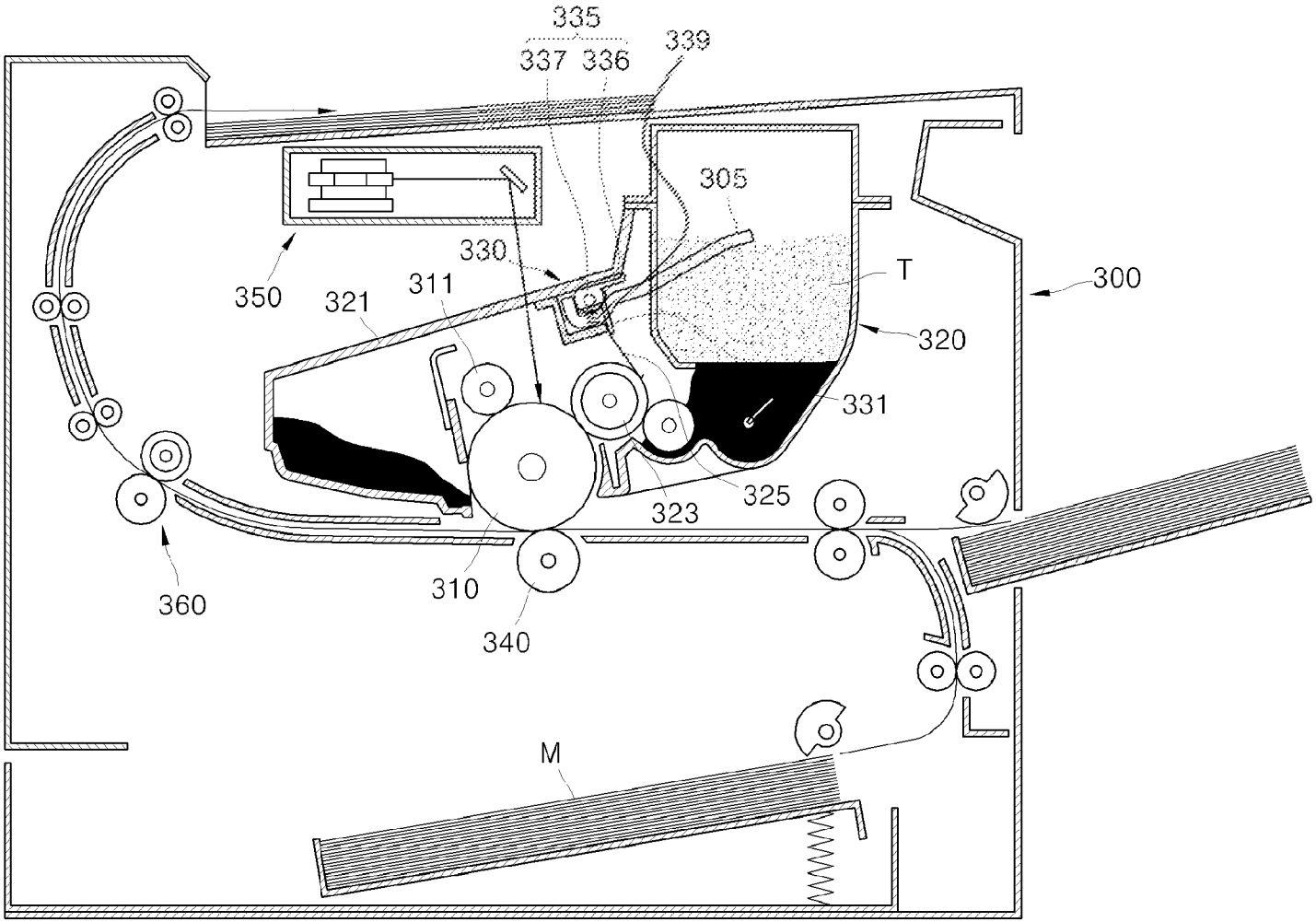
FIG. 6 is a schematic cross-sectional view of an image forming apparatus according to an exemplary embodiment of the present general inventive concept.

Referring to FIG. 6, the image forming apparatus includes a housing 300, a photosensitive medium 310 provided in the housing 300, a developing unit 320, a transfer unit 340, which transfers an image developed in the photosensitive medium 310 to a printing medium M, and a fusing unit 360, which fixes the image transferred to the printing medium M. The photosensitive medium 310 is charged with a predetermined electric potential by a charger 311 and responds to a beam scanned from a light scanning unit 350 to form an electrostatic latent image corresponding to an image to be printed.

The developing unit 320 is installed in the housing 300 and provides a toner T to the photosensitive medium 310 to form an image. Thus, the developing unit 320 includes a developing frame 321, a developing member 323 installed in the developing frame 321 and providing the toner T to the photosensitive medium 310 to develop an image, a blade 325 to regulate a toner layer on the developing member 323, and a position changing part 330 to change a contact position of the blade 325 on the developing member 323.

The position changing part 330 includes a bracket 331 to support the blade 325, a position adjusting member 335 to adjust a contact position of the blade 325 on the developing member 323, and an elastic member 339, which elastically presses the bracket 331 so that the blade 325 is elastically biased against the developing member 323. The position adjusting member 335 includes a cam 336 installed on the developing frame 321 to move the bracket 331 up and down and a lever 337 to adjust the cam 336.

A configuration and an operation of the developing unit 320 are the same as those in the first and the second exemplary embodiments and descriptions thereof are incorporated herein.

The developing unit 320 is provided as a single-body cartridge together with the photosensitive medium 310, which is replaced when the toner T accommodated therein is depleted. The housing 300 may further include a guide member 305 therein to guide the developing unit 320 to be mounted to a correct position therein.

The guide member 305 guides the developing unit 320 during mounting of the developing unit 320 and regulates a position of the lever 337 so as to determine a position of the blade 325.

Figure 7:
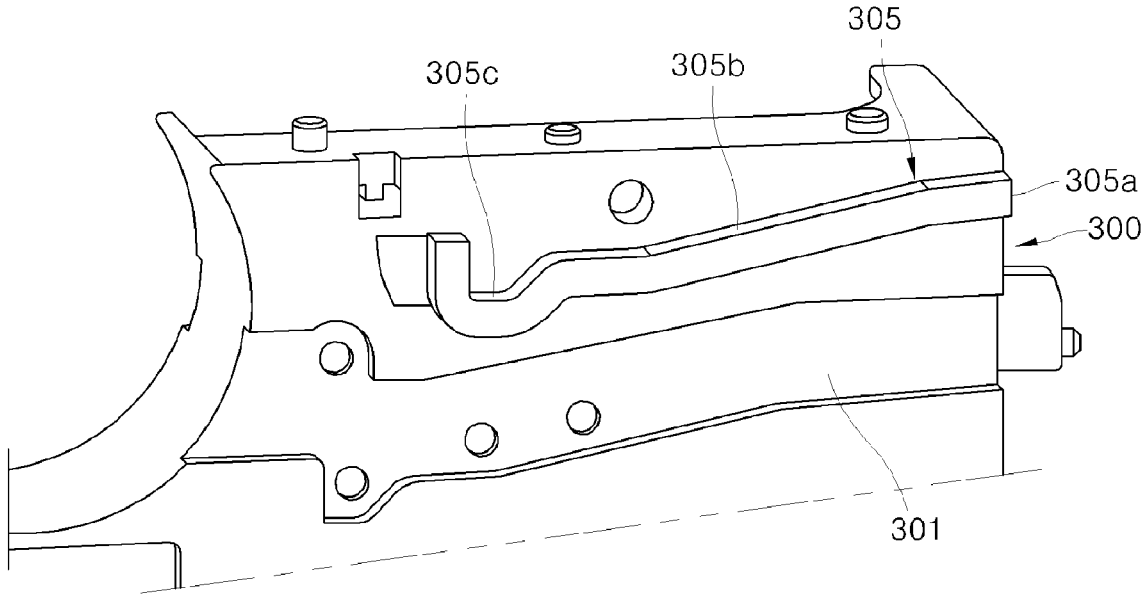
FIG. 7 is a partial perspective view of a main frame of the image forming apparatus in FIG. 6.

Referring to FIG. 7, the guide member 305 may have a structure of a guide rail which protrudes from an inside wall of the main frame 301 of the housing 300. The guide member 305 has a shape so the blade 325 moves upward to be in contact with the developing member 323 at a different position when the lever 337 pivotally rotates as the developing unit 320 is mounted. The guide member 305 includes an introduction part 305*a* to introduce the developing unit 320, a guide part 305*b* to guide the developing unit 320 into the housing 300, and a seating part 305*c* to seat the developing unit 320.

Hereinafter, a process where the developing unit 320 is mounted in the housing 300 will be described with reference to FIGS. 8A to 8C.

Figure 8A:
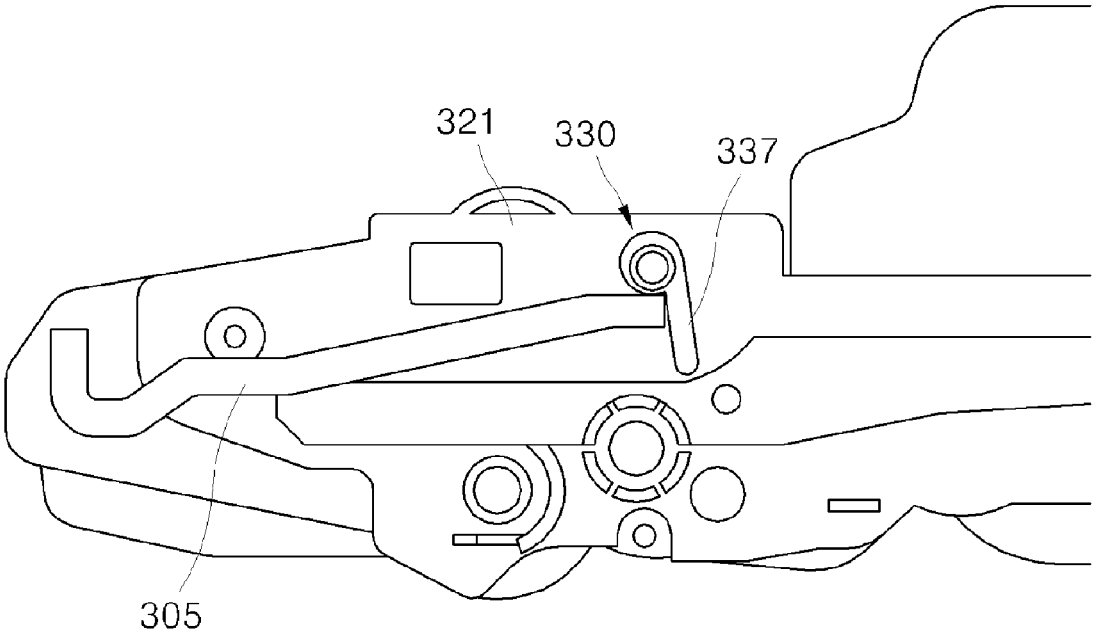
FIGS. 8A to 8C illustrate a process where the developing unit in FIG. 3A is mounted to the main frame in FIG. 7.
Figure 8B:
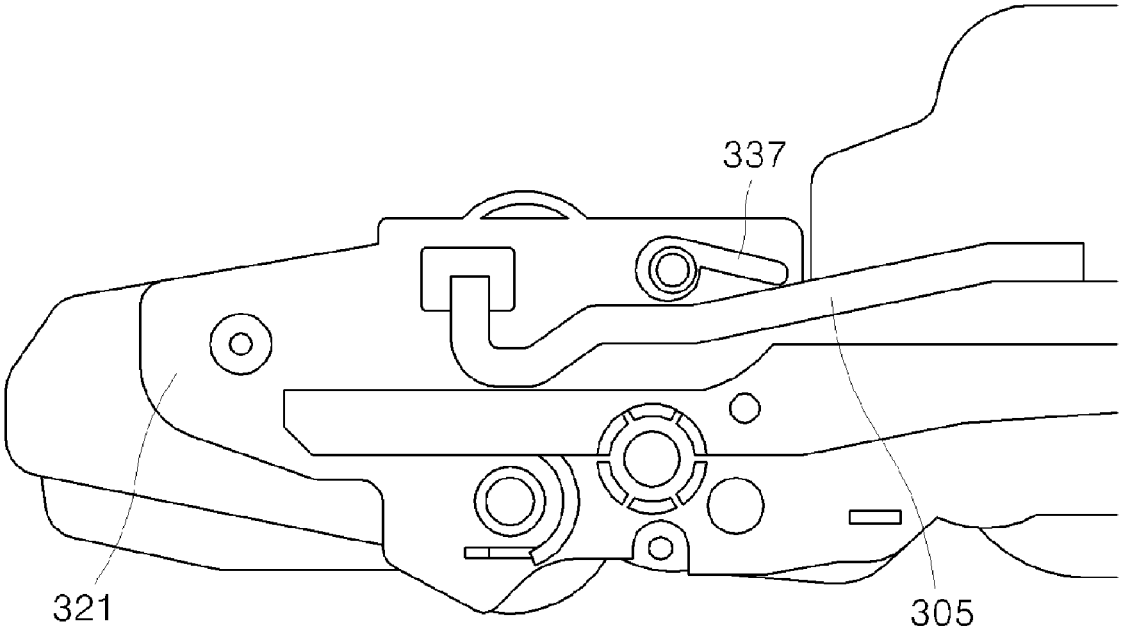

Referring to FIG. 8A, when the developing unit 320 is introduced to the introduction part 305*a*, the lever 337 is in contact with the introduction part 305*a* in an upright state. Then, the lever 337 is rotated by a contact force generated by the lever 337 and the introduction part 305*a*. Referring to FIG. 8B, the developing unit 320 progresses along the guide part 305*b* so that the lever 337 is rotated. Referring to FIG. 8C, the lever 337 is seated on the seating part 305*c*, at which point the mounting of the developing unit 320 is completed.

Figure 8C:
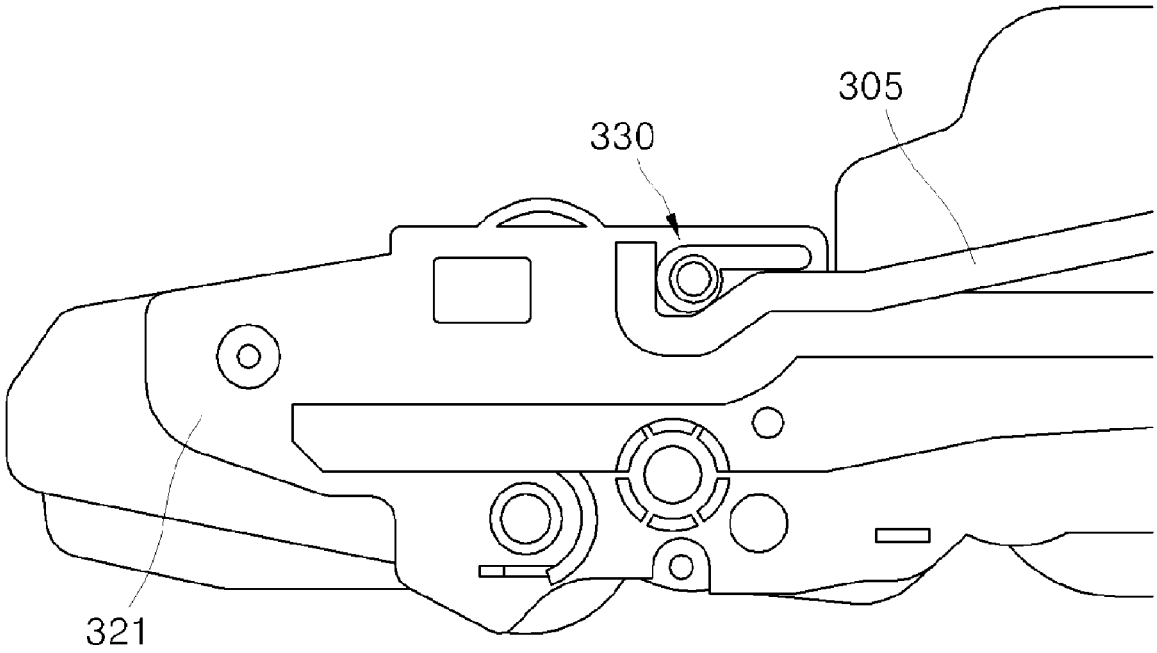

A position of the lever 337 in FIG. 8A corresponds to a position of the blade 325 in FIG. 5A, and a position of the lever 337 in FIG. 8C corresponds to a position of the blade 325 in FIG. 5B.

As described above, as the lever 337 rotates, a contact position of the blade 325 on the developing member 323 changes from the position $P_4$ to the position $P_3$ of a position of a bending part 230*a*.

Meanwhile, the contact position is the position $P_4$ before the developing unit 320 is mounted, and a coating agent of the toner is adhered thereto. The contact position becomes the position $P_3$ moved as much as a positional variation $\Delta m$ from the position $P_4$ after the developing unit 320 is mounted, thereby preventing generation of a streak.

Since the position $P_4$ is not a bent portion, a contact area of the developing member 323 and the blade 325 is wide relative to a mounting state of the developing unit 320. Thus, the pressure applied between the developing member 323 and the blade 325 is an interactive pressure that is distributed so that the pressure is decreased. Accordingly, the developing member 323 and the blade 325 are prevented from being deformed in a state when the developing unit is not mounted. Further, the coating agent of the toner and degree of adherence on the developing member 323 is decreased due to the low interactive pressure, thereby reducing the migration generated by adhesion of the toner on the developing member 323.

As described above, in a developing unit and an image forming apparatus using the same according to the present general inventive concept, a contact area of the blade changes depending on whether the developing unit is mounted to the image forming apparatus or not mounted to the image forming apparatus.

Thus, the present general inventive concept provides a stable image quality by controlling generation of a streak or migration on a screen, which is caused by adhesion of a coating agent of a toner on a contact surface of a blade and a developing member. As such, the user is able to minimize dangerous maintenance operations whereby the user is required to clean the blade while avoiding a surface of the blade where a coating agent is adhered.

Further, a blade with a simple configuration may change its contact position without additional configurations, thus allowing a user to execute minimized maintenance operations whereby the blade is automatically moved away from the coating agent in the contact position when the developing unit is mounted to the image forming apparatus, thereby improving convenience. Accordingly, an image quality of the image forming apparatus can be enhanced.

With respect to contact pressure of a blade to a developing member, a pressure less than that necessary for printing is applied when not in use, thus decreasing and thereby improving a degree of adherence of a coating agent to the blade, but also a degree of pressure exerted on the developing member by the pressure of the blade. Accordingly, a likelihood of deformation of the blade and the developing member are decreased.

Although a few exemplary embodiments of the present general inventive concept have been illustrated and described, it will be appreciated by those skilled in the art that changes may be made in these exemplary embodiments without departing from the principles and spirit of the general inventive concept, the scope of which is defined in the appended claims and their equivalents.

What is claimed is:

1. A developing unit comprising:

a developing frame;

a developing member installed in the developing frame and to provide a toner to a photosensitive medium to develop an image;

a blade to regulate a toner layer on the developing member; and a position changing part to change a contact position of the blade on the developing member, wherein the blade comprises a bending part which is bent in its end portion near the developing member to maintain a constant pressure at the free end portion of the blade in contact with the developing member so that the position changing part regulates a thickness of the toner layer.

2. The developing unit according to claim 1, wherein the position changing part comprises:

a bracket to support the blade movably installed on the developing frame; and a position adjusting member to move the bracket to adjust the contact position of the blade on the developing member.

3. The developing unit according to claim 2, wherein the position changing part changes the contact position of the blade on the developing member if the developing frame is mounted to a main frame of an image forming apparatus.

4. The developing unit according to claim 3, wherein the position adjusting member moves the bracket so that the blade moves in a direction away from the developing member when the developing frame is mounted to the main frame.

5. The developing unit according to claim 2, wherein the position adjusting member comprises:

a cam which reciprocatively moves the bracket; and a lever to adjust the cam.

6. The developing unit according to claim 2, wherein the position changing part further comprises an elastic member to elastically press the bracket so that the blade is elastically biased against the developing member.

7. The developing unit according to claim 1, wherein the contact position of the blade is adjusted by the position adjusting member so that the bending part is in contact with the developing member when the developing unit is mounted to the image forming apparatus and a portion of the blade other than the bending part is in contact with the developing member when the developing unit is not mounted to the image forming apparatus.

8. The developing unit according to claim 1 , wherein a bending radius of the bending part is in a range of 0.05 mm to 0.5 mm.

9. An image forming apparatus comprising:

a housing having a main frame;

a photosensitive medium to form an electrostatic latent image;

a developing unit installed on the main frame, having a developing member disposed in a developing frame, and to provide toner to the photosensitive medium to form an image;

a blade to regulate a toner layer on the developing member; and a position changing part to change a contact position of the blade on the developing member;

a transfer unit to transfer the image formed in the developing unit to a printing medium; and a fusing unit to fuse the image transferred to the printing medium, wherein the blade comprises a bending part which is bent in its end portion near the developing member to maintain a constant pressure at the free end portion of the blade in contact with the development member so that the position changing part regulates a thickness of the toner layer.

10. The image forming apparatus according to claim 9, wherein the position changing part comprises:

a bracket to support the blade movably installed on the developing frame;

a position adjusting member to adjust the contact position of the blade on the developing member; and an elastic member to elastically press the bracket so that the blade is elastically biased against the developing member.

11. The image forming apparatus according to claim 10, wherein the position adjusting member moves the bracket so that the blade moves in a direction away from the developing member when the developing frame is mounted to the main frame.

12. The image forming apparatus according to claim 10, wherein the position adjusting member comprises:

a cam which reciprocatively moves the bracket; and a lever to adjust the cam.

13. The image forming apparatus according to claim 12, further comprising:

a guide member disposed in the main frame to guide the developing unit to be mounted, and to regulate a position of the lever to determine a position of the blade when the developing unit is mounted.

14. The image forming apparatus according to claim 9, wherein a contact position of the blade is adjusted by the position adjusting member so that the bending part is in contact with the developing member when the developing unit is mounted to the image forming apparatus and a portion of the blade other than the bending part is in contact with the developing member when the developing unit is not mounted to the image forming apparatus.

15. An image forming apparatus comprising:

a photosensitive medium; and a developing unit to develop an image of the photosensitive medium using a developer, the developing unit having a developing frame, a developing member disposed in the developing frame to provide a toner to an outside thereof, and a blade to regulate a toner layer and change a contact position of the blade on the developing member, to change from a first configuration to a second configuration upon activation of the developing member, and to automatically revert to the first configuration upon deactivation of the developing member, wherein the first configuration positions a larger portion of the blade away along a straight path from the developing member relative to the second configuration.

16. A developing unit of an image forming apparatus, comprising:

a developing frame;

a developing member disposed in the developing frame to provide a toner to an outside thereof; and a blade to regulate a toner layer, to change from a first configuration to a second configuration upon activation of the developing member, and to automatically revert to the first configuration upon deactivation of the developing member, such that a contact position of the blade on the developing member is changed, wherein the first configuration positions a larger portion of the blade away along a straight path from the developing member relative to the second configuration.

17. The developing unit according to claim 16, wherein less pressure is exerted on the developing member in the first configuration relative to the second configuration.

18. A blade apparatus usable with a developing unit, the developing unit comprising:

a developing frame; and a developing member installed in the developing frame and to provide toner to a photosensitive medium to develop an image; and the blade apparatus comprising:

a blade to regulate a toner layer on the developing member; and a position changing part to change a position of the blade on the developing member, such that a contact position of the blade on the developing member is changed, wherein the blade comprises a bending part which is bent in its end portion near the developing member to maintain a constant pressure at a free end portion of the blade in contact with the development member so that the position changing part regulates a thickness of the toner layer.

* * * * *